US005725303A

United States Patent [19]

Lin

[11] Patent Number: 5,725,303

[45] Date of Patent: Mar. 10, 1998

[54] LAMPSHADE AND GUARD NETTING ARRANGEMENT OF A HALOGEN LAMP

[76] Inventor: Shih-Ming Lin, No. 132, Hsi Hsin Street, Chuang Ya Tsun Hsiu Shui Hsiang, Chang Hua Hsien, Taiwan

[21] Appl. No.: 723,363

[22] Filed: Sep. 30, 1996

[51] Int. Cl.[6] ..... F21V 15/00

[52] U.S. Cl. ..... 362/376; 362/414

[58] Field of Search ..... 362/263, 376, 362/410, 414, 290, 291

[56] References Cited

U.S. PATENT DOCUMENTS

| | | | |
|---|---|---|---|
| 1,625,693 | 4/1927 | Vest | 362/455 |
| 2,469,412 | 5/1949 | Roebken | 362/376 |
| 4,959,762 | 9/1990 | Soileau | 362/376 |
| 5,016,154 | 5/1991 | Leeyeh | 362/414 |
| 5,408,399 | 4/1995 | Atkins et al. | 362/376 |
| 5,660,464 | 8/1997 | Lin | 362/376 |

*Primary Examiner*—Stephen F. Husar

*Attorney, Agent, or Firm*—Beveridge, DeGrandi, Weilacher & Young, L.L.P.

[57] ABSTRACT

A guard netting for protecting the top opening of a lampshade that directs light upwards to prevent objects falling against the light bulb within the lampshade. The guard netting is designed to be inserted into different sized lampshades. The guard netting has multiple mounting holes for the attachment of locating plates with a screw and nut. Each locating plate will extend beyond the edge of the guard netting to hold the guard netting in place within a lampshade at a position below the flange at the top of the lampshade.

3 Claims, 2 Drawing Sheets

LAMPSHADE AND GUARD NETTING ARRANGEMENT OF A HALOGEN LAMP

BACKGROUND OF THE INVENTION

The present invention relates to halogen lamps, and relates more specifically to the arrangement of the lampshade and guard netting of a halogen lamp in which locating plates are radially and adjustably fastened to the rim of the guard netting by screws and nuts, and adjusted to secure the guard netting to the inside of the lampshade.

When a halogen lamp is used, it produces high heat. If a halogen lamp is designed to project light upwards, the top opening of the lampshade must be covered with guard means for protection. If the top opening of the lampshade is not well protected, a window screen, curtain, etc., may be forced by a wind to partially insert into the lampshade, and be burned by heat.

SUMMARY OF THE INVENTION

The present invention has been accomplished to provide a guard netting and lampshade arrangement for a halogen lamp which eliminates the aforesaid problem. According to the present invention, the guard netting and lampshade arrangement comprises a bowl-like lampshade adapted for holding a halogen lamp tube and having a top opening and inward flange around the top opening, and a guard netting mounted in the lampshade and covered over the halogen lamp tube, wherein the guard netting comprises a rim having a diameter smaller than the top opening of the lampshade, a plurality of mounting holes at the rim, and a plurality of locating plates respectively and radially adjustably fastened to the mounting holes of the guard netting by a respective screw and a respective nut and partially projecting over the periphery of the rim. The locating plates have a respective oblong hole through which is respective screw passes. By means of the oblong hole of each locating plate, the locating plates can be adjusted radially outwards to fix the guard netting to the inside of the lampshade after the loading of the guard netting in the lampshade.

DETAILED DESCRIPTION OF THE PREFERRED EMBODIMENT

Figure 1:
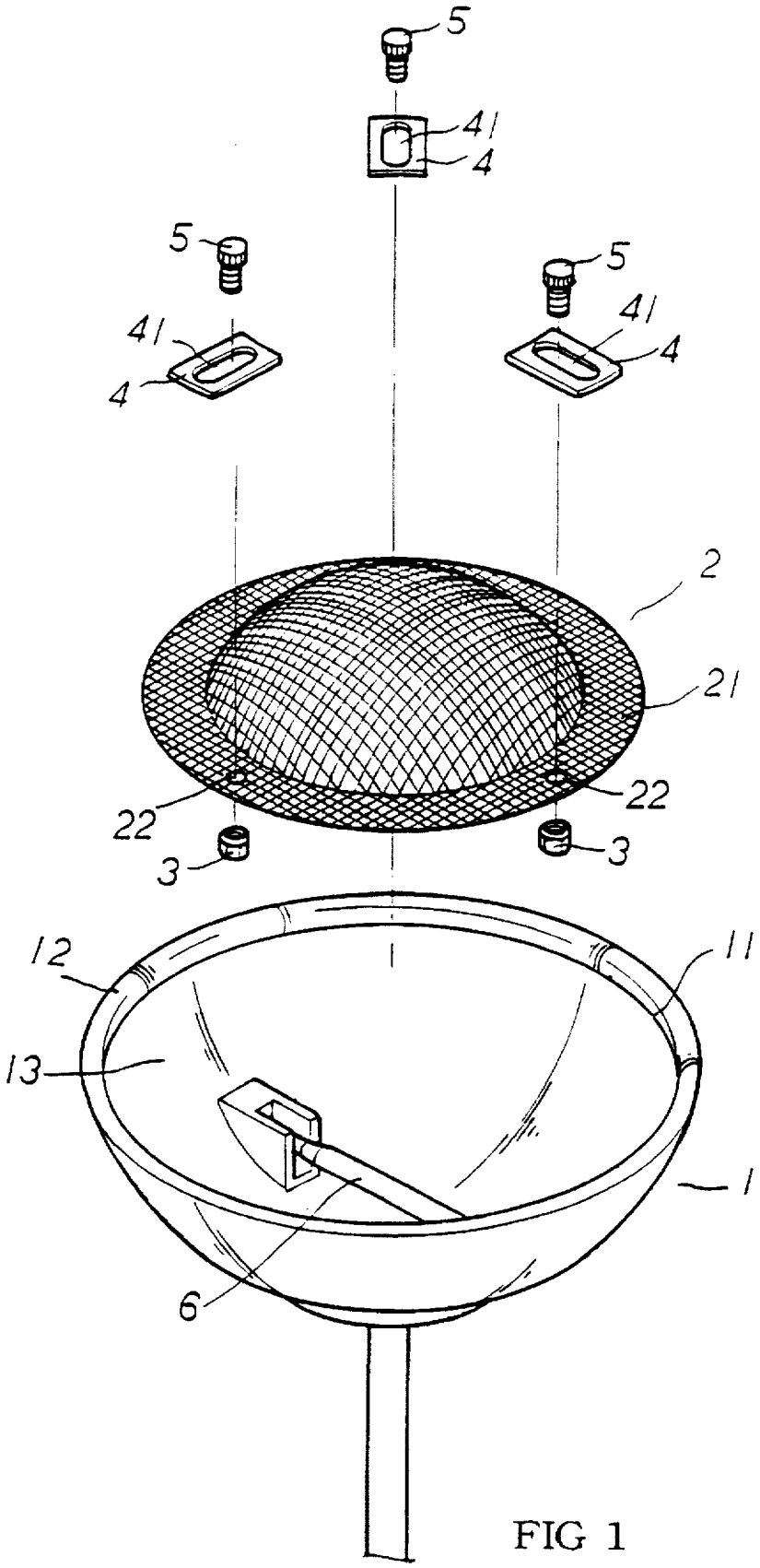
FIG. 1 is an exploded view of the present invention.

Referring to FIG. 1, the present invention comprises a lampshade 1 which is shaped like a rounded bowl having a top opening 11, and a guard netting 2 adapted for covering on the top opening 11 of the lampshade. The guard netting 2 has a rim 21, and a plurality of mounting holes 22 on the rim 21. A plurality of locating plates 4 are respectively fastened to the mounting holes 22 of the guard netting 2 by a respective screw 5 and a respective nut 3. Each locating plate 4 has an oblong hole 41 through which the respective screw 5 passes. When the locating plates 4 are respectively to the mounting holes 22 of the guard netting 2, they partially project over the periphery of the rim 21. By loosening the nuts 3, the locating plates 4 can be adjusted radially relative to the guard netting 2.

Figure 3:
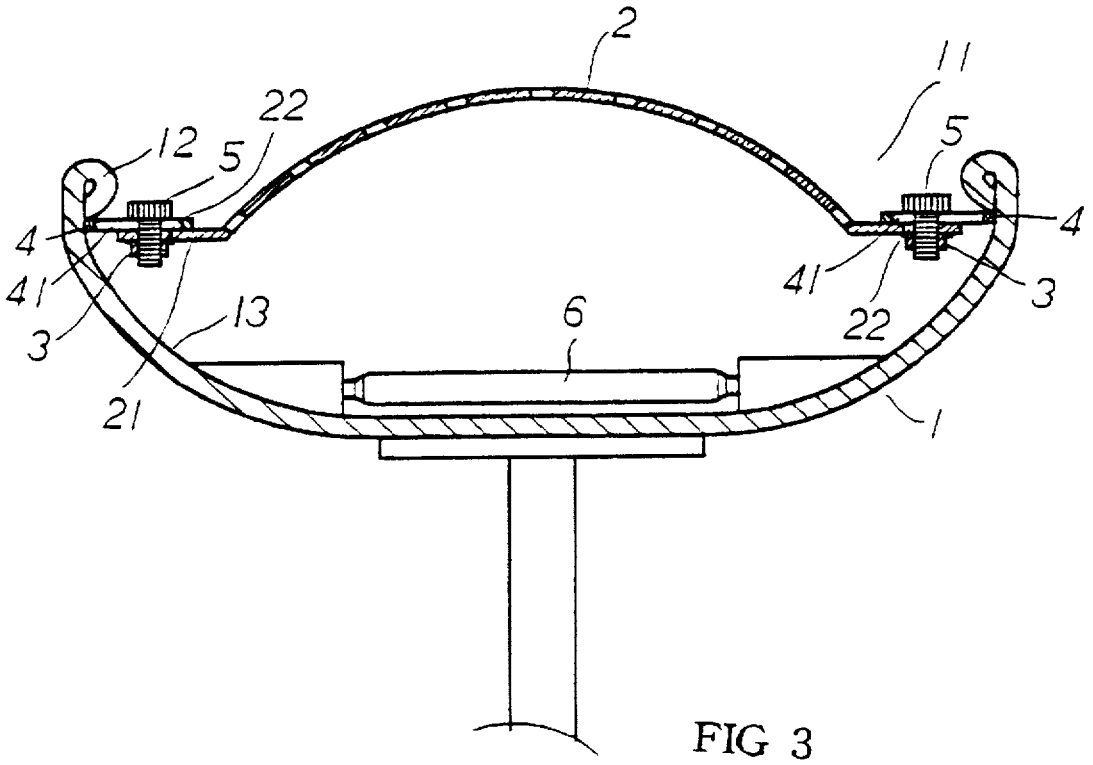
Figure 2:
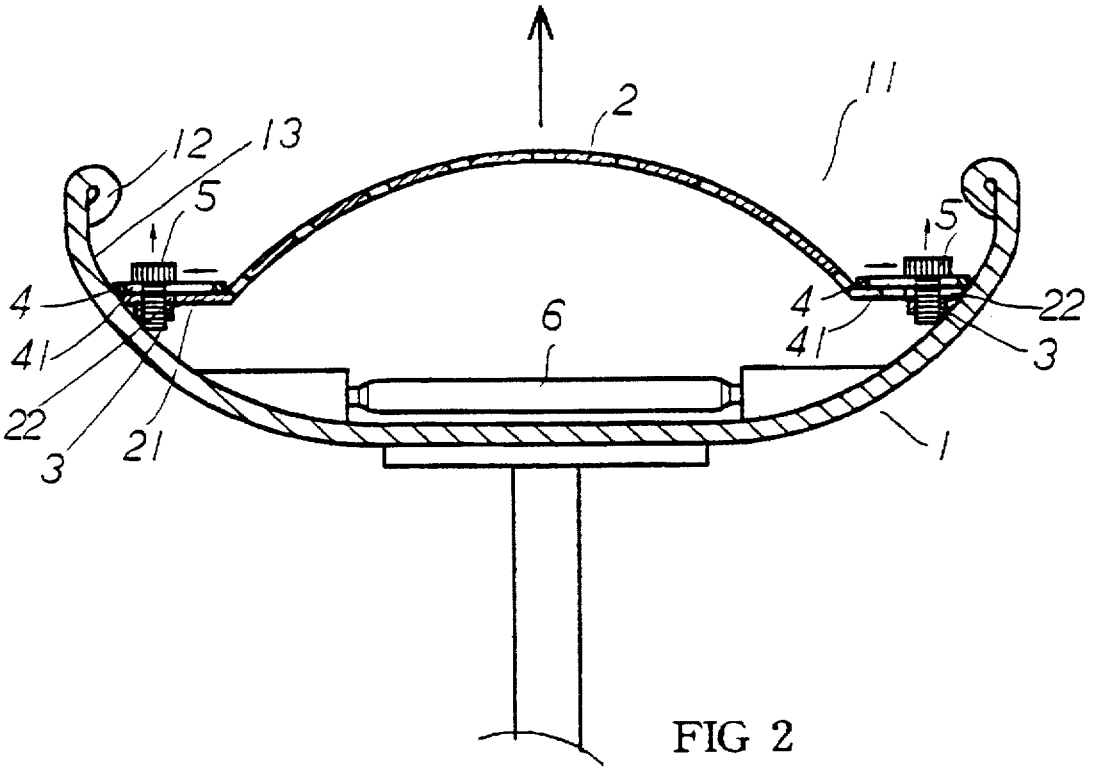
FIG. 2 is a sectional view of the present invention, showing the guard netting put inside the lampshade according to the present invention; and, FIG. 3 is another sectional view of the present invention, showing the guard netting fixed to the lampshade.

Referring to FIGS. 2 and 3, and FIG. 1 again, the lampshade 1 holds a halogen lamp tube 6 on the inside, having an inward flange 12 raised from the inside wall 13 around the top opening 11. When the locating plates 4 are adjusted toward the center of the guard netting 2, the guard netting 2 can then be put in the lampshade 1 (see FIG. 2). When the guard netting 2 is put in the lampshade 1, the locating plates 4 are adjusted again and stopped below the inward flange 12 of the lampshade 1.

While only one embodiment of the present invention has been shown and described, it will be understood that various modifications and changes could be made thereunto without departing from the spirit and scope of the invention disclosed.

What the invention claimed is:

1. A guard netting assembly capable of installation within a lampshade having an inside wall and a flange extending inwardly about a periphery of the inside wall of the lampshade, said guard netting assembly comprising:

a guard netting having a rim, said rim having a plurality of mounting holes passing therethrough, and means in communication with said plurality of mounting holes on said rim of said guard netting for holding said guard netting within the lampshade and below the flange;

said holding means contacting the inside wall of the lampshade to hold said guard netting in place within the lampshade.

2. A guard netting assembly as recited in claim 1, wherein said holding means includes:

a locating plate for each of said mounting holes, said locating plate having an oblong hole passing therethrough, a screw passing through said oblong hole and a corresponding mounting hole, and a nut for securing said screw and said locating plate to said rim of said guard netting;

wherein an end of said locating plate extends beyond said rim of said guard netting; and whereby said guard netting is held within said lampshade by the ends of said locating plates contacting the inner wall of the lampshade.

3. A guard netting assembly capable of installation within a lampshade having an inside wall and a flange extending inwardly about a periphery of the inside wall of the lampshade, said guard netting assembly comprising:

a guard netting having a rim, said rim having a plurality of mounting holes passing therethrough, a locating plate for each of said mounting holes, said locating plate having an oblong hole passing therethrough, a screw passing through said oblong hole and a corresponding mounting hole, and a nut for securing said screw and said locating plate to said rim of said guard netting;

wherein an end of said locating plate extends beyond said rim of said guard netting; and whereby said guard netting is held within said lampshade by the ends of said locating plates contacting the inner wall of the lampshade.

* * * * *